United States Patent [19]

Pisanu

[11] 4,377,308

[45] Mar. 22, 1983

[54] ASYMMETRICAL ANATOMIC ARM-CHAIR, PARTICULARLY FOR ODONTOLOGICAL USE

[76] Inventor: Antonio Pisanu, C.so Vittorio Emanuele, 108, 07010 Ittiri (Sassari), Italy

[21] Appl. No.: 236,880

[22] Filed: Feb. 23, 1981

[30] Foreign Application Priority Data

Feb. 29, 1980 [IT] Italy ..... 20274 A/80

[51] Int. Cl.[3] ..... A47C 1/032; A47C 7/02

[52] U.S. Cl. ..... 297/353; 269/324; 297/459

[58] Field of Search ..... 297/353, 458–460, 297/391; 269/322–324

[56] References Cited

U.S. PATENT DOCUMENTS

| | | | |
|---|---|---|---|
| 148,380 | 3/1874 | Perrenet | 297/354 |
| 3,552,797 | 1/1971 | D'Houdain | 297/355 |
| 3,565,419 | 2/1971 | Allard | 269/325 |
| 3,572,816 | 3/1971 | Brown | 297/459 X |
| 3,984,146 | 10/1976 | Krestel et al. | 297/330 |

FOREIGN PATENT DOCUMENTS

| | | | |
|---|---|---|---|
| 201804 | 7/1958 | Austria | 297/459 |
| 2164191 | 7/1973 | France . | |
| 276561 | 9/1927 | United Kingdom . | |
| 601087 | 4/1948 | United Kingdom . | |
| 880237 | 10/1961 | United Kingdom | 297/460 |

*Primary Examiner*—William E. Lyddane
*Attorney, Agent, or Firm*—Fisher, Christen & Sabol

[57] ABSTRACT

The invention is directed to an automatic arm-chair including a seat, a back articulated to the seat, and a headrest articulated to the back. The seat is substantially rigid and has an asymmetrically contoured surface for supporting a patient with one side at a lowered position to the other side, and the trunk slightly rotated and turned towards the lowered side. The back is formed of a rigid curved band with curvature of very large radius at the patient's highest side, and minor radius at the patients lowered side.

12 Claims, 14 Drawing Figures

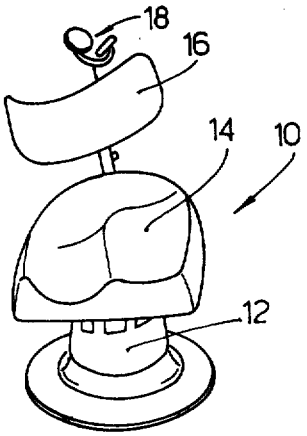
FIG. 1
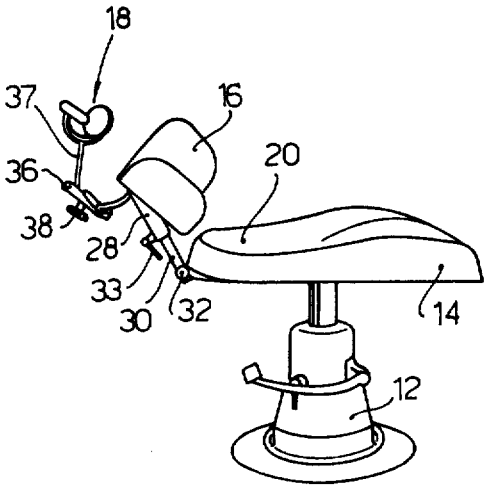
FIG. 2
FIG. 3
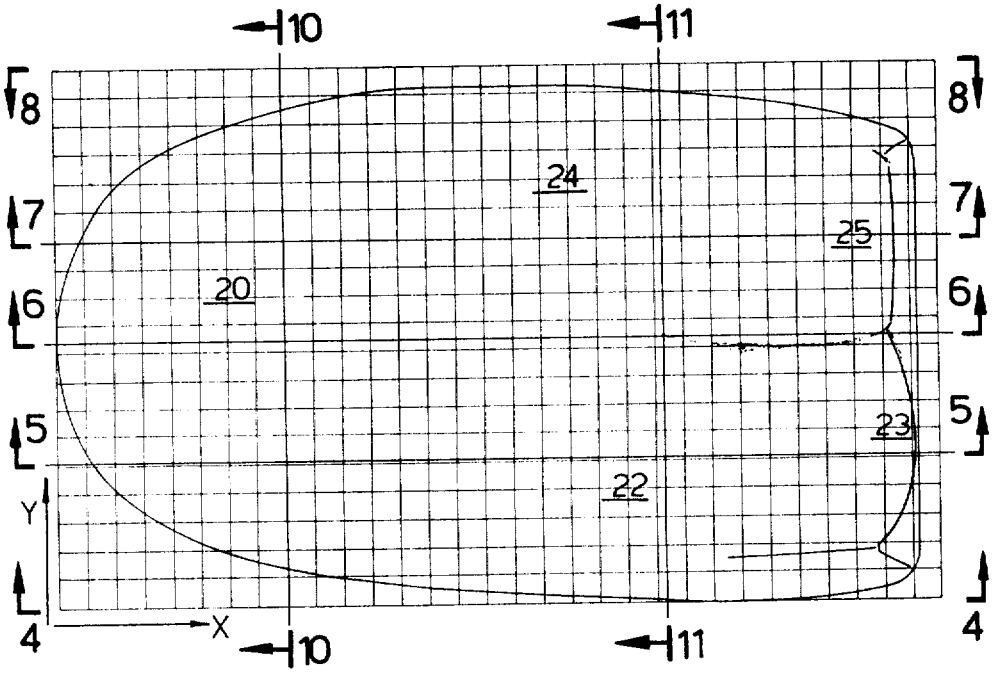

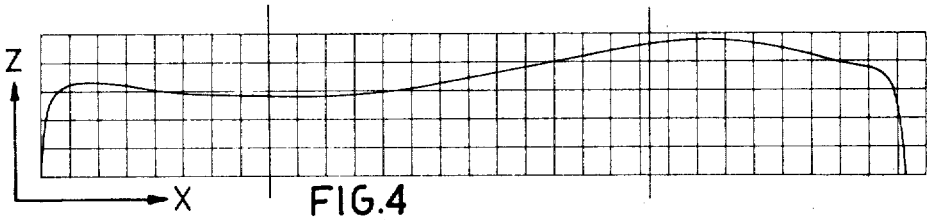
FIG.4
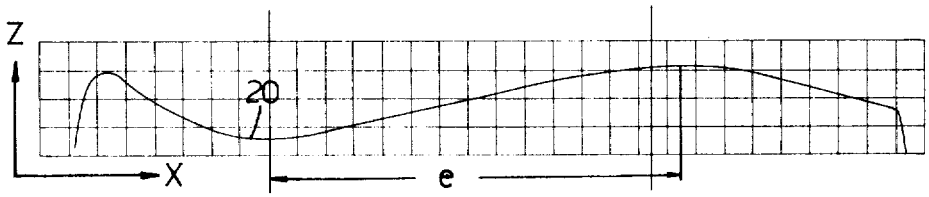
FIG.5
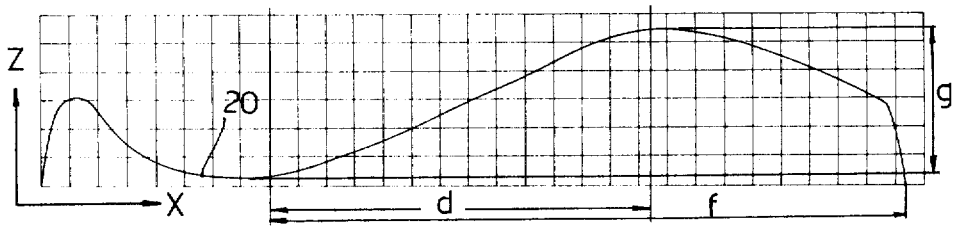
FIG.6
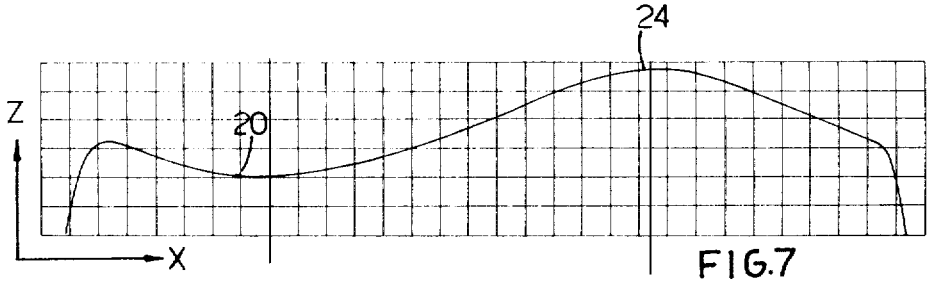
FIG.7
FIG.8
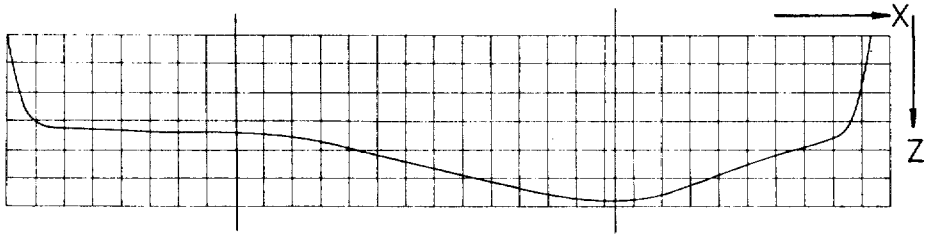

FIG. 13
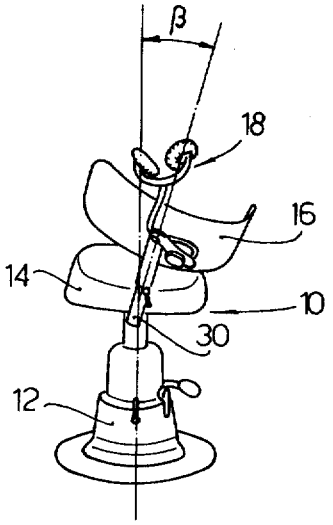
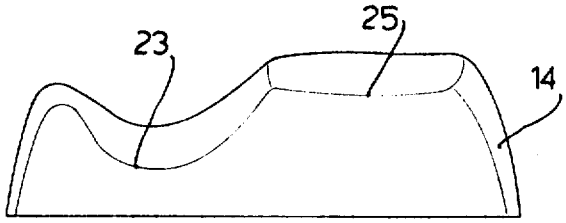
FIG. 9
FIG. 10
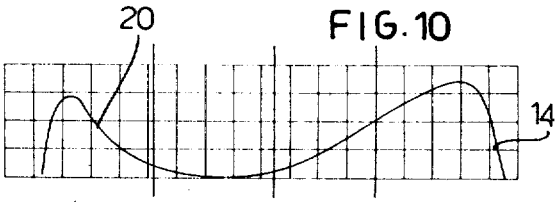
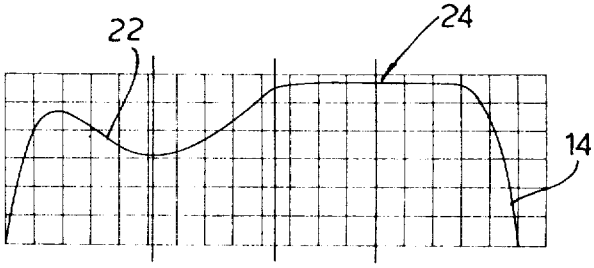
FIG. 11
FIG. 12
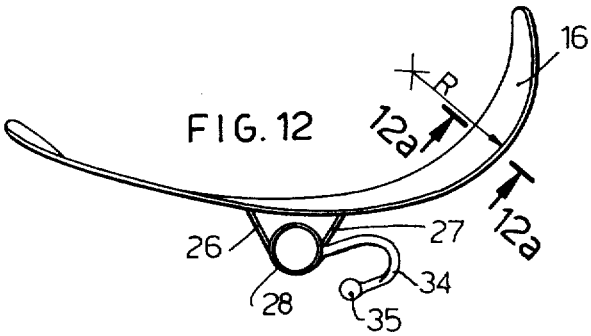
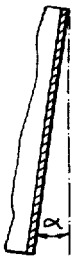
FIG. 12a

ASYMMETRICAL ANATOMIC ARM-CHAIR, PARTICULARLY FOR ODONTOLOGICAL USE

BACKGROUND OF THE INVENTION

1. Field of the Invention

This invention relates to an arm-chair for a patient, particularly for odontological use.

2. Description of the Prior Art

At present there are many arm-chairs available for odontological use and those most known are essentially of two types. A first type has a symmetrical anatomic seat, or a padded seat, of a limited extension in order to accommodate the top portion of the patient's legs up to the knee; a patient would dispose himself at sitting position thereon. A second type of arm-chair, and that of most widespread use, has a couch or cot type of extended symmetrical seat, so as to completely accommodate the patient's legs: the back is movable between two positions, that is to say a supine position and a sitting position, and is not adjustable in height.

These types of arm-chairs having a back that cannot be adapted to the individual patient and a headrest with much restricted movements, almost always in only one direction, do not allow a rational work area and cause the operator to take uncorrect and detrimental positions.

In odontology the operating field is of small size and almost always located in a cavity accessible through a narrow aperture; thus, it requires that an operator is placed in front of it, taking an orthopedically correct sitting position. The structures of the present arm-chairs raise an obstacle against the operator's lower limbs; whereby it is difficult to reach the correct vision distance both for standard visus and use of myopia, hypermetropy, presbyopia or magnifying lenses. Difficulty further arises in effecting a correct clinical examination with the patient's bipupillary axis arranged in horizontal and parallel direction to the dentist's bipupillary axis; such a position is essential in order to obtain functional and aesthetic data, and is the only one valid for controlling the ratios between the dental arches by direct vision; it being known, for example, how distorted or altered are the articular relationships at supine position. Many operations in surgery, prosthesis and orthodontia are also impossible without forcing an operator to detrimental contortions, flexions and rotations.

Therefore, the aim of this invention was to provide an arm-chair, particularly for odontological use, which would allow a comfortable position to a patient, while enabling an operator to operate at an orthopedically correct and comfortable position.

SUMMARY OF THE INVENTION

The arm-chair of the present invention provides a comfortable position for its occupant and enables its operator to operate at an orthopedically correct and comfortable position. On a seat base or mounting of any conventional type, the novel arm-chair comprises a rigid seat of anatomic shape, a back articulated relative to the seat, and a headrest. The anatomic seat is of truncated asymmetrical shape, that is to say it has one hollow to accommodate one leg (generally the right leg) of a larger depth than the hollow to accommodate the other, or left leg, so as to support a patient with one side at lowered position and slightly rotated, and is of a length such that the patient's heels are prevented from resting. According to a further aspect of this invention, the novel chair has a back carried on a column adjustable in forward and backward inclination and in height with respect to the seat, and the back is formed of a curved strap or band having asymmetrical curvature with the minor radius to that side where the hollow of larger depth is provided in the seat. According to a still further aspect of the invention, the back column has a constant inclination with respect to a longitudinal vertical plane containing the pivot point between the column and seat. According to still another aspect of the invention, the back strap has some twist. And according to a further aspect of the invention, the headrest of an angularly adjustable type and comprising rest pads is mounted on a base arm integral with the column or in any case with the back, which arm is curved and affords a larger possibility of adaptation.

By overcoming all of the above mentioned drawbacks, the novel arm-chair allows a patient to sit comfortably down facing the operator, who can operate sitting and at an orthopedically correct position, that is with straight bust and head and legs naturally spread apart.

This novel position is provided through an anatomic moulding of the seat accommodating the patient's pelvis and lower limbs as rotated and outwardly inclined. With its shape such a seat adheres to the anatomic structures of a patient evenly distributing the weight thereof and by maximizing the bearing surface reduces the load by surface unit of the patient's body. By its smooth rigid surface, it makes easy the frequent adjustments which at sitting or lying down position are effected in order to alleviate and relieve the more compressed zones, and by its truncated shape it prevents the foot and particularly the heel from resting, thus avoiding the weight of the lower limbs from resting on the reduced surface of the heel, creating hyperpressure zones, which cause discomfort.

The position for the bust, as set and determined by the seat, is maintained by the arm-chair back which with its curved shape inclined in forward-backward direction and with its upward and rotational movements accommodates the structures of the individual patient, supporting the latter and providing a comfortable rest for the shoulder. Finally, on upward sliding due to the column inclination, the back also outwardly moves, providing an increased space in case of tall persons. By an universal joint, the headrest allows the widest displacements of the head and even minimum adjustments in all of the directions as requested by the operator.

BRIEF DESCRIPTION OF THE DRAWINGS

A more detailed description of the invention will be given with reference to the accompanying drawings, in which:

FIG. 1 is a front perspective view of an arm-chair according to the present invention;

FIG. 2 is a view taken from the left side of FIG. 1;

FIG. 3 is a plan view of a seat according to the present invention;

FIGS. 4, 5, 6, 7 and 8 show curves described by the seat as seen in front and sectional planes 4—4, 5—5, 6—6, 7—7 and 8—8, respectively, of FIG. 3;

FIG. 9 is a front elevational view of a seat according to the present invention;

FIGS. 10 and 11 are sectional views taken along lines 10—10 and 11—11 of FIG. 3, respectively;

FIG. 12 is a plan view of the back drawn on the same scale as that of FIGS. 3 to 11;

FIG. 12*a* is a fragmentary vertical sectional view taken along the back at the maximum twist position; and FIG. 13 is a rear view of the arm-chair on a different scale from that of the preceding figures.

DETAILED DESCRIPTION OF THE INVENTION

With reference to the figures of the accompanying drawings, an arm-chair is herein described for arranging a patient as inclined on his right side towards the operator. If preferred, the arm-chair can be readily made for a leftward inclination of the patient, without departing for this from the field or scope of the present invention.

Referring to FIG. 1, an arm-chair according to the invention comprises a base 12, a chair or seat 14, a back 16, and a headrest 18.

Said base 12 may be of any known type and therefore will not be described. Particularly, such a base will be of a type allowing upward and downward adjusting displacements, for example by means of a hydraulically or electrically controlled telescopic system.

Said seat 14 is of substantially rigid material, generally molded plastics, and has a truncated asymmetrical anatomic shape, that is to say it has such an extension as to support the patient's legs naturally at an extended position, while the heels, on which pressure concentrations result more easily, are left without any support or rest, such pressure concentrations being cause of discomfort. The anatomic shape of seat 14 comprises (FIGS. 2, 3 and 10) a rear hollow 20 for accommodating the patient's pelvis. This rear hollow 20, as shown in FIG. 10 which is a sectional view through a vertical plane, substantially at the deepest zone of the hollow, is smoothly curved, and it will be seen that the deepest zone is displaced at one side relative to the center, and such a zone has a curvature of smaller radius than the curvature of the zone to the other side. Considering now a section through a vertical plane of the seat, at the zone thereof corresponding approximately to the patient's raised knee (FIG. 11) the dissymmetry of the two parts of the seat will be more evident. Particularly, in the example described, while the seat has on one side a concavity 22 intended to accommodate the patient's right leg, on the other side the seat has a surface 24 which is at a considerable higher level than said concavity 22 for the rest or bearing of the patient's left leg thereon.

As shown in FIG. 9, it will be seen that in the terminal chair section, substantially at the patient's calves, such a seat has two asymmetrical concavities 23 and 25 for the right and left legs, respectively. Only by way of example, some size values are hereinafter given in connection with a particular exemplary embodiment of the seat, as shown in the figures of the accompanying drawings. Of course, such size values should not in any case be considered as restrictive.

Distance or spacing d (FIG. 6) between a vertical plane through the point of maximum depth for the pelvis and a vertical plane through the position of maximum height for the left knee, d=about 40 cm.

Distance or spacing e (FIG. 5) between a vertical plane through the point of maximum depth for the pelvis and the position of maximum height for the right knee, e=42.5 cm.

Distance or spacing between the point of maximum depth for the pelvis and the truncated or end section for the chair, f=67 cm.

Difference in height between the zone of maximum depth for the pelvis and that of maximum height for the left knee, g=about 17.3 cm.

Difference in height between the zone of maximum depth for the pelvis and that of maximum height for the right knee, h=9.4 cm (g-h=7.9 cm).

Considering now a triad of axes x, y, as in FIG. 3 and z orthogonal to the plane thereby defined, the following indicative values are given:

section 10—10 at x=24 cm
section 11—11 at x=64
truncated or end section at about 91 cm
section 5—5 at about y=15.3 cm
section 6—6 at about y=28 cm In the figures of the accompanying drawings there is given for convenience a checkering with squares having sides of 3 cm.

Further values are shown in the following Tables 1 and 2.

TABLE 1

| x (cm) = | View from 4-4 z (cm) = | View from 8-8 z (cm) = | Sect. 5-5 z (cm) = | Sect. 6-6 z (cm) = | Sect. 7-7 z (cm) = |
|---|---|---|---|---|---|
| 3 | 9,7 | 9,2 | / | 9,1 | / |
| 6 | 9,9 | 9,8 | 9,4 | 7,8 | / |
| 9 | 9,5 | 10 | 9,3 | 4,3 | 7,7 |
| 12 | 9 | 10 | 8.2 | 2.3 | 5.5 |
| 15 | 8,8 | 10 | 7.2 | 1.4 | 3.8 |
| 18 | 8.7 | 10 | 6.6 | 1 | 2.6 |
| 21 | 8.6 | 10.1 | 6.2 | 0.8 | 1.8 |
| 24 | 8.5 | 10.2 | 6.3 | 0.9 | 1.5 |
| 27 | 8.3 | 10.2 | 6.5 | 1.4 | 1.8 |
| 30 | 8.4 | 10.6 | 6.9 | 2.4 | 2.3 |
| 33 | 8.5 | 11.1 | 7.3 | 3.5 | 3.1 |
| 36 | 8.7 | 11.8 | 8.1 | 4.7 | 3.8 |
| 39 | 9.2 | 12.4 | 9 | 6 | 4.5 |
| 42 | 9.7 | 13.1 | 10 | 7.4 | 5.1 |
| 45 | 10.3 | 14 | 11.1 | 8.8 | 5.7 |
| 48 | 11 | 14.7 | 12.4 | 10.1 | 6.5 |
| 51 | 11.6 | 15.6 | 13.6 | 11.5 | 7.2 |
| 54 | 12 | 16.2 | 14.9 | 13 | 7.8 |
| 57 | 12.6 | 16.7 | 16 | 14.4 | 8.3 |
| 60 | 13.1 | 17.1 | 16.8 | 15.5 | 8.7 |
| 63 | 13.7 | 17.4 | 17.2 | 16.3 | 9.1 |
| 66 | 14.1 | 17.4 | 17.4 | 16.5 | 9.2 |
| 69 | 14.3 | 16.8 | 17 | 16.2 | 9.3 |
| 72 | 14.3 | 15.7 | 16.1 | 15.6 | 9.1 |
| 75 | 14 | 14.6 | 15 | 14.7 | 8.7 |
| 78 | 13.5 | 13.5 | 13.7 | 13.6 | 8 |
| 81 | 12.8 | 12.5 | 12.5 | 12.5 | 7.3 |
| 84 | 12 | 11.7 | 11.3 | 11.2 | 6.5 |
| 87 | 11.5 | 10.7 | 10.1 | 9.8 | 5.5 |

TABLE 2

| Section 11-11 | | Section 10-10 | |
|---|---|---|---|
| y = 3 cm | z = 12 cm | y = 6 cm | z = 8.3 cm |
| 6 cm | 14 cm | 9 cm | 6.4 cm |
| 9 cm | 12.4 cm | 12 cm | 3.2 cm |
| 12 cm | 10.3 cm | 15 cm | 1.7 cm |
| 15 cm | 9.5 cm | 18 cm | 0.6 cm |
| 18 cm | 9.8 cm | 21 cm | 0.1 cm |
| 21 cm | 11 cm | 24 cm | 0.1 cm |
| 24 cm | 13 cm | 27 cm | 0.5 cm |
| 27 cm | 15.6 cm | 30 cm | 1.2 cm |
| 30 cm | 17 cm | 33 cm | 2.5 cm |
| 33 cm | 17 cm | 36 cm | 4.4 cm |
| 36 cm | 17.2 cm | 39 cm | 6.3 cm |
| 39 cm | 17.2 cm | 42 cm | 8 cm |
| 42 cm | 17.2 cm | 45 cm | 9.5 cm |
| 45 cm | 17.2 cm | 48 cm | 10.4 cm |

TABLE 2-continued

| Section 11-11 | | Section 10-10 | |
|---|---|---|---|
| 48 cm | 17.1 cm | = = | = = |

These dimensional values have been found particularly valid for a patient's comfort and adaptation to patients of various heights. However, as above mentioned, such values are not to be understood as restrictive.

The seat is mounted on the base so as to leave a sufficient space there beneath for the operator's legs, so that the operator can operate at sitting position, which is possible due to the patient's arrangement on the novel arm-chair.

The arm-chair back (FIG. 12) is composed of a comparatively thin band so as not to develop space problems. The band is curved and twisted. The curvature has a very large radius at the area corresponding to the patient's left shoulder and the radius decreases at the bearing area for the patient's right shoulder. A convenient value for radius R is about 12 cm. The back part for the right shoulder is twisted, taking with respect to a horizontal plane a minor angle of inclination than that at the left shoulder.

In the exemplary embodiment such a twist may be indicated by an angle $\alpha$ of few degrees relative to the untwisted condition, at the vertical section where the twist is at a maximum value.

By means of welded plates 26 and 27, the back band has secured thereon a sleeve 28 which can be fitted on the back column 30. Said column 30 is mounted on the chair by a hinge 32 which can be clamped by a nut, which hinge has not been shown, because of being of any known type. The column 30 is inclined by an angle $\beta$ (generally about 12°) relative to the vertical.

Said sleeve 28 is adjustable in height on the column 30 and adjustable for rotation about its own axis and the axis of column 30 and can be clamped by an any known type of clamping device 33. Welded to said sleeve 28 there is a lower arm 34 for the headrest articulation or joint, terminating with a ball 35, having mounted thereon the articulation 36 for adjustable supporting headrest 18. Such an articulation is of known type and is mounted on two end balls, of which one is said ball 35, and the other is fast with the headrest stem 37. The articulation is tightened by clamping on said balls through the hand grip or knob 38. Because of being of known type, such an articulation has not been described and shown in detail. The curved arch shape of the lower arm 34 permits a larger possibility of adaptation to various positions for the headrest.

On an arm-chair according to this invention, a patient is on one side (generally on the right side) facing the operator. Therefore, an operator can operate under optimum conditions, that is at sitting position (the free space rearwardly of the base allows to arrange the operator's legs), while the minimum occupation of space of the back allows free movement for the operator's arm. Substantially, the operator is in front of the patient. In turn, the latter is at an extremely comfortable position, because of resting on a wide surface of the body and in addition, owing to the rigidity and sufficiently slidable surface of the chair can arrange himself thereon without any difficulty.

What I claim is:

1. An anatomic arm-chair comprising a seat, a back articulated with respect to the seat and a headrest articulated to the back, wherein said seat is substantially rigid and has an asymmetrical anatomically contoured surface for supporting a patient with one side at lowered position relative to the other side, and the trunk slightly rotated and turned towards the lowered side.

2. An arm-chair according to claim 1, wherein the total extension of the seat is such as to support a patient's legs up to the calf, excluding the patient's heels from the rest or bearing.

3. An arm-chair according to claim 1, wherein the back is formed of a rigid curved band with curvature of very large radius at the patient's highest side, and minor radius at the patient's lowered side.

4. An arm-chair according to claim 3, wherein the band of the back has a twist, so as to have a smaller angle of inclination $\alpha$ relative to a horizontal plane at the patient's lowered side with respect to his other side.

5. An arm-chair according to claim 1, wherein said back is articulated to said seat by a sleeve integral with the back, which is telescopically mounted on a column hingedly connected to the seat, and is rotatable about the column axis.

6. An arm-chair according to claim 5, wherein the hinged connection between said column and seat is adjustable in height in forward-backward inclination.

7. An arm-chair according to claim 5, wherein said column has a fixed inclination relative to a middle longitudinal vertical plane of the seat.

8. An arm-chair according to claim 7, wherein said inclination is about 12°.

9. An arm-chair according to claim 1 or 5, wherein said headrest is articulated on an arm integral with the back sleeve and said arm has a loop or arch curved shape.

10. An arm-chair according to claim 1, wherein said seat is carried on a base adjustable in height and rotation and said base carries the seat at such a position thereof as to leave a free space rearwardly thereof.

11. An arm-chair according to claim 1, wherein some indicative measures for the seat are given as follows:

distance between a vertical plane through the point of maximum depth for a patient's pelvis and a vertical plane for the position of maximum height for a knee, d=about 40 cm;

distance between a vertical plane through a point of maximum depth for the pelvis and the position of maximum height for the patient's other knee, e=-about 42.5 cm;

distance between the point of maximum depth for the pelvis and the truncated section for the chair, f=about 67 cm;

difference in height between the zone of maximum depth for the pelvis and that of maximum height for the highest knee, g=about 17.3 cm; and difference in height between the zone of maximum depth for the pelvis and that of maximum height for the lowest knee, h=about 9.4 cm.

12. A rigid seat for an anatomic arm-chair wherein said seat has an asymmetrical anatomically contoured surface for supporting a patient, with one side at lowered position relative to the other side, and the trunk slightly rotated and turned towards the lowered side.

* * * * *